US005527035A

United States Patent [19]

Marshall

[11] Patent Number: 5,527,035

[45] Date of Patent: Jun. 18, 1996

[54] ROLLING HEAD PUTTER

[76] Inventor: William Marshall, 320 Watson Rd., Oxford, Ala. 36203

[21] Appl. No.: 406,739

[22] Filed: Mar. 20, 1995

[51] Int. Cl.[6] ..... A63B 69/36

[52] U.S. Cl. ..... 473/230; 473/328; 473/340

[58] Field of Search ..... 273/174, 167 A, 273/167 C, 167 J, 169, 172, 193 R, 194 R, 194 A, 194 B, 167 B, 167 D, 168, 170, 173, 175, 167 H; D21/214, 217

[56] References Cited

U.S. PATENT DOCUMENTS

| | | | |
|---|---|---|---|
| D. 193,399 | 8/1962 | McGranaghan | 273/174 |
| 2,300,043 | 10/1942 | Carney | 273/174 |
| 3,319,964 | 5/1967 | Steinberg | 273/194 A |
| 3,466,046 | 9/1969 | McTenigue | 273/162 |
| 3,893,673 | 7/1975 | Welsh | 273/183 R |
| 4,017,083 | 4/1977 | Johnson | 273/164 |
| 4,523,758 | 6/1985 | Guendling, Jr. | 273/77 R |
| 4,535,992 | 8/1985 | Slagle | 273/194 A |
| 4,647,045 | 3/1987 | Bilyeau | 273/163 A |
| 5,207,721 | 5/1993 | Lobdell | 273/174 |

*Primary Examiner*—Steven Wong
*Attorney, Agent, or Firm*—John D. Gugliotta

[57] ABSTRACT

A rolling head putter that comprises a standard design putter head in conjunction with an axle and rotatable roller. The axle supports the roller and provides for free rotation of the roller in a direction orthogonal to the direction of the line of sight in the direction of the putt. The roller is mounted behind the leading edge of the putter and may have a resilient outer surface, and extends below the lower surface of the putter head such that the putter head rests on and glides across the ground surface on the roller. In a preferred embodiment, the axle and roller are contained within and bounded by a cavity that penetrates the putter head, such that the overall perimeter of the putter head is of similar size and shape to generally available standard putter heads.

7 Claims, 4 Drawing Sheets

ROLLING HEAD PUTTER

BACKGROUND OF THE INVENTION

1. Field of the Invention

The present invention relates generally to golf equipment and, more particularly, to a golf putter specially designed to assist and train a golfer to have more success with putts.

2. Description of the Related Art

As is well known in the art, a number of different kinds of golf clubs, and especially putters are known. Relevant of these golf putters, the prior art can generally be grouped into two categories: putter use aiding devices, and putt-training devices.

Putter use aiding devices are disclosed in the art as a means to assist the golfer in using a typical putter, or as an improved putter for use during a game of golf. For instance, in U.S. Pat. No. 4,647,045 issued in the name of Bilyeau, a putter guide is disclosed. The putter guide disclosed in the Bilyeau invention is an attachment to the shaft of a putter that aids in aligning the golf club at a right angle to a line between the ball and the hole. Designed as a foldable pointing device, the Bilyeau invention attaches to the shaft of a putter and deploys to provide a guide for the putter user. With the addition of a painted surface to allow for contrast with the putting surface, the Bilyeau invention also addresses the problem not addressed in previous art of the golfer's eyes having difficulty in simultaneously focussing on the ball, the club face, and the pointer of the putter guide concurrently and thereby losing sight of the pointer device.

Another problem that occurs from the use of a typical putter is the turning of the putter head while in use by the golfer. This putting error is caused by the imperceptible turning of the shaft of the putter as the head of the putter approaches or comes into contact with the ball. Numerous attempts have been made to correct for this problem. In U.S. Pat. No. 4,523,758 issued in the name of Guendling, Jr., a golf club putter is disclosed. In its preferred embodiment, the Guendling, Jr. invention envisions a one-handed putting method, thereby eliminating any turning of the shaft caused by using a two-handed grip.

Other methods for eliminating the putting error caused by the turning of the putter shaft during use are known. For instance, U.S. Pat. No. 4,017,083, issued in the name of Johnson, discloses a putter device that includes an internal spinning gyroscope device inside the putter head to provide sufficient momentum necessary to prevent any "turning" of the shaft when the putter head approaches or comes in contact with the ball. However, a putter made in accordance with this reference is associated with several drawbacks, the most significant of which is that a putter made in accordance with the Johnson invention would not appear to meet all of the requirements and rules of the U.S. Golf Association.

Additionally, many putt-training devices are disclosed in the prior art that attempt to assist a golfer in developing proper, consistent habits that generally result from practice conducted with the proper information feedback. For example, in U.S. Pat. No. 3,466,046 issued in the name of McTeigue, a mechanical putter is disclosed. In McTeigue, a regulation putter is removably mounted on a bracket that is connected to a ratchet and pawl arrangement designed to provide a forward force and motion that is determined directly by the amount of backswing imparted on the device. As disclosed in the McTeigue invention, the device assists the user in learning to swing a putter in a proper arc, and thereby teach the user to provide the proper amount of force necessary to impart to the putter.

Also, in U.S. Pat. No. 3,893,673 issued in the name of Welch, a golf club is disclosed that comprises a head, a handle, and a spring loaded impact surface that can be loaded and then discharged against a golf ball, thereby imparting a set, known force thereto. In the Welch invention, the preferred embodiment is used in the instruction of putting a golf ball by propelling a practice ball toward a cup with a standard force dependent solely on the distance between the ball and the cup. Using the Welch invention, a golfer can then judge from the path followed by the practice shot what corrections in force and direction are necessary to make an accurate putt.

And finally, in U.S. Pat. No. 5,207,721 issued in the name of Lobdell, a putter is disclosed that comprises a putter head having an axle and a pair of coaxial rotatable wheels. In the Lobdell invention the putter can be rolled on the wheels as the putter is advanced. As disclosed by the Lobdell preferred embodiment, a striking surface on the putting head that is convex insures that as the putter is rolled, proper contact will be made between the head and the ball. However, even though this convex striking surface provides for proper ball-head orientation during use, such a custom surface design actually decreases the training effectiveness of such a device by unnecessarily eliminating a number of actual use variables from the training regime.

Consequently, a need has been felt for providing an apparatus and method of improving putting skills and assisting a golfer in practicing a number of aspects of putting, such as: keeping the putter off the ground during the swing before contact is make with the ball; preventing turning of the wrists during backswing, stroke, and followthrough; and, providing energy transfer from club head to ball in a manner similar to that which occurs with regulation type putters.

SUMMARY OF THE INVENTION

It is therefore an object of the present invention to provide an improved rolling head putter that eliminates scuffing and twisting and allows the club head energy to be transferred to the ball more consistently, thereby improving putting skills.

It is a further object of the present invention to provide an improved rolling head putter that integrates a roller within the head of a standard putter.

It is yet another object and feature of the subject invention to provide a putter which is ideally suited for use as a training tool for improving both aim and distance when putting.

Briefly described in accordance with a preferred embodiment, the subject invention consists of a rolling head putter, which is composed of a rolling head and a shaft. The rolling head comprises a standard putter head, with the exception that a cavity exists to house a roller which is rotatably mounted on a axle with bearings which enables the roller to move. The integrated roller keeps the putter head elevated to the proper distance above the ground, eliminating scuffing the ground and losing the momentum intended to hit the ball, and prevents twisting of the shaft that can result from turning of the golfers wrists.

The advantages of the present invention are to eliminate scuffed putts or twisting of the putter shaft, thereby keeping the putter head more on line with a straight, continuous follow through. By practicing with the present invention the user is forced to develope proper and improved putting habbits, thereby improving putting skills while using a regular putter.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
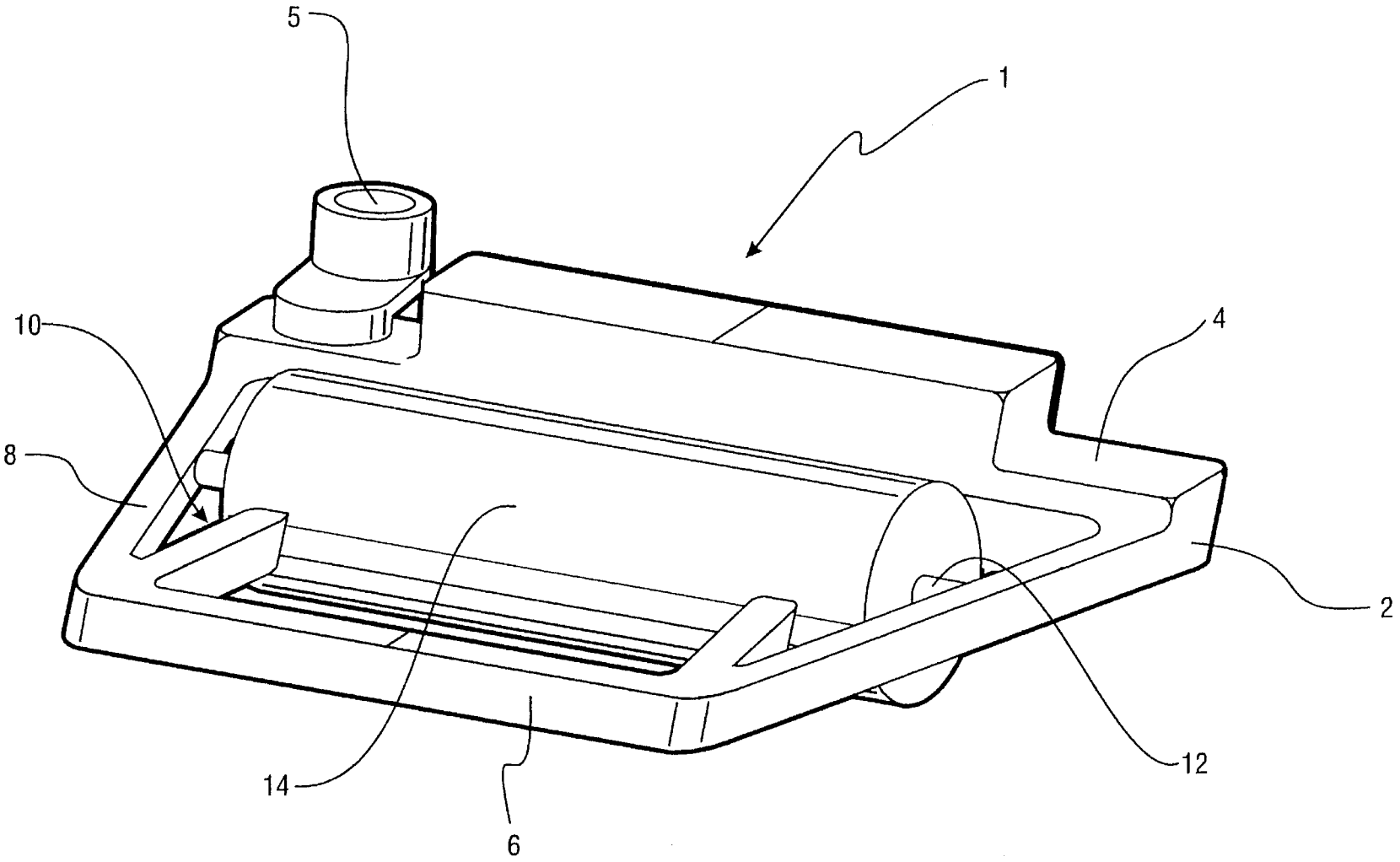
FIG. 1 is an orthographic view of a rolling head putter according to a preferred embodiment of the present invention.

Referring now to FIG. 1, a rolling head putter apparatus, generally connotated as 1, is shown according to the present invention. A putter head 2 is shown in a typical configuration. According to the preferred embodiment, a putter head is of a general overall size and shape as would otherwise be permissible pursuant to the rules and regulations of the U.S. Golf Association, or as is currently commonly available. As such, said putter head 2 is comprised of a generally flat face 4, shaft socket 5, and body 6. Said body comprises frame 8, forming a perimeter which defines and encloses a cavity 10 within and completely through said body 6. The frame 8 also contains, attaches, and supports an axle 12. The axle 12 supports a freely rotating roller 14 which extends beneath the lower surface of the head 2 in order to contact the ground. It is envisioned that utilizing bearings may provide for improved rotation of the roller 14 around the axle 12. It is also envisioned that the roller 14 include a resilient outer peripheral surface in order to prevent slipping and facilitate rolling.

Figure 2:
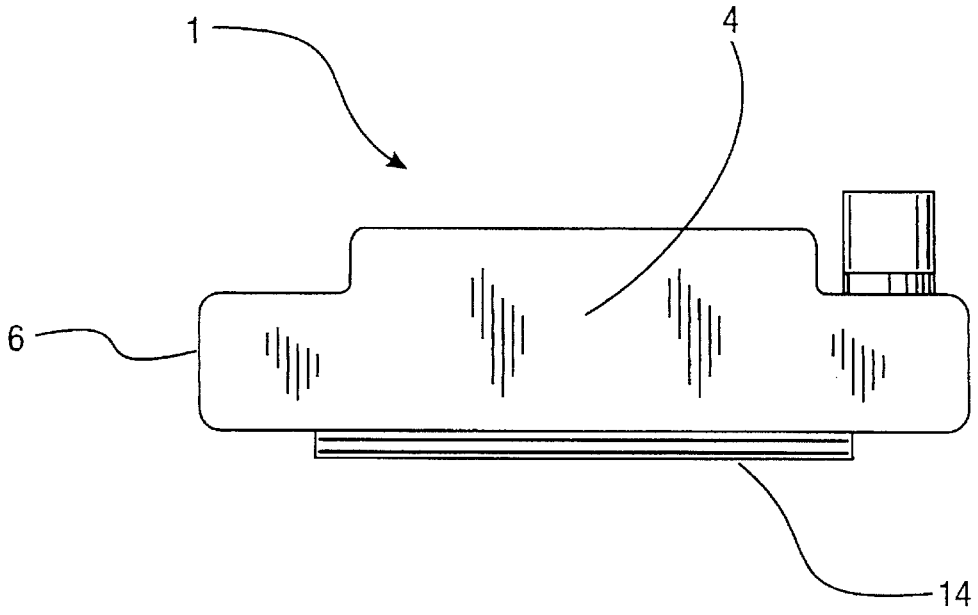
FIG. 2 is a front view of a rolling head putter according to a preferred embodiment of the present invention.

Referring now to FIG. 2, the front view of the rolling head putter apparatus 1 is shown. Most specifically depicted is the relationship between the roller 14, the face 4, and the body 6. As is depicted according to the preferred embodiment, the roller 14 is situated behind the face 4, and is mounted such that it is free rotatable and that the body 6 rests above the ground when the roller 14 is in contact with the ground.

Figure 3:
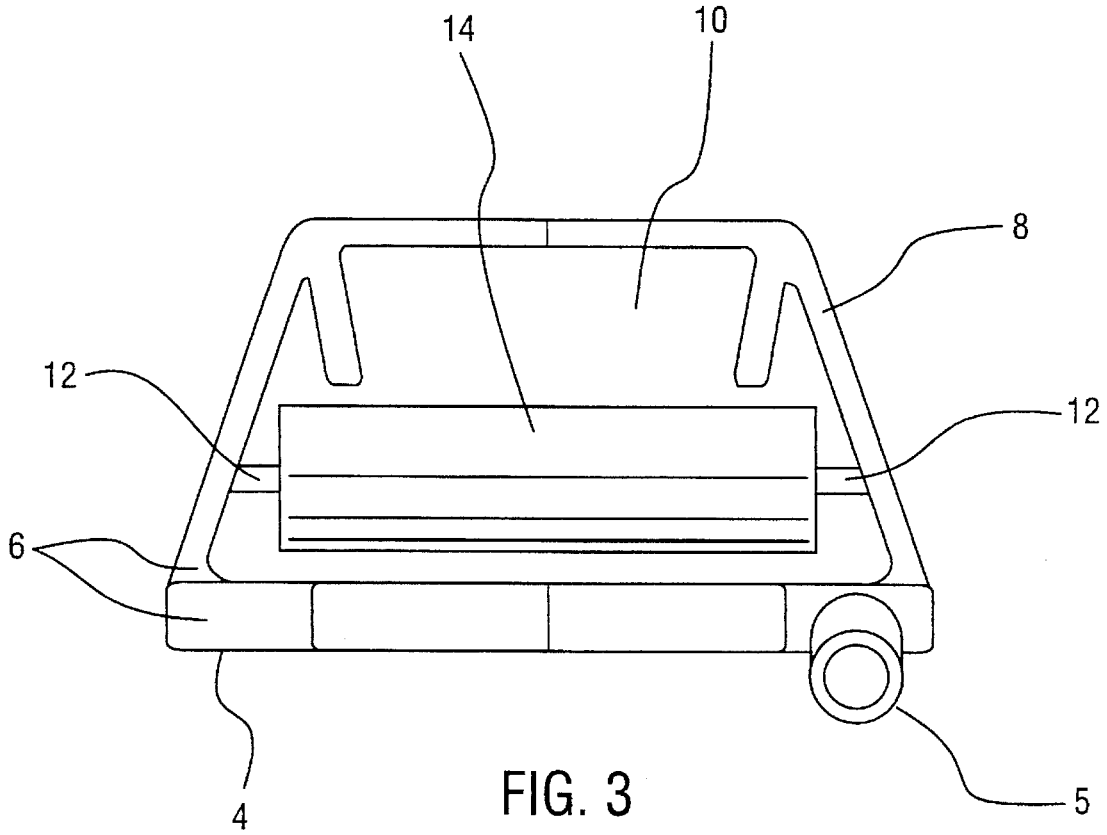
FIG. 3 is a top view of a rolling head putter according to a preferred embodiment of the present invention.

In FIG. 3, the top view of the rolling head putter apparatus 1 is shown, which more specifically depicts the manner in which the frame 8 encompasses and forms a cavity 10 within the body 6. The frame 8 contains and is attached to a axle 12, which supports the freely rotating roller 14. Also depicted in further detail is the location of the roller 14 situated behind the face 4. From the top view, the generally tubular shaft socket 5 is located on the generally right side of the body 6, for use by a right-handed golfer. It is also envisioned that the shaft socket 5 could be located on the generally left side of the body 6 for use by a left-handed golfer.

Figure 4:
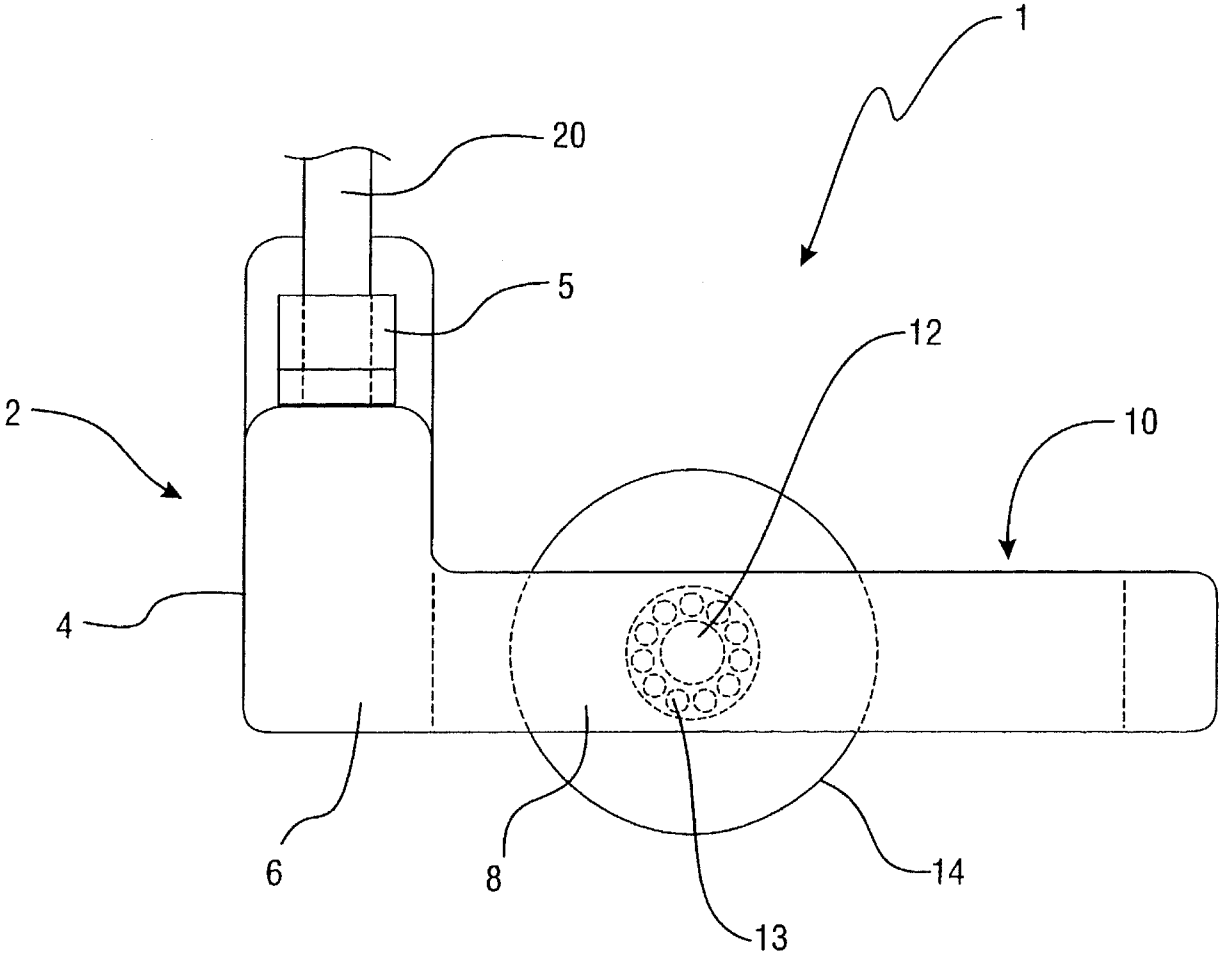
FIG. 4 is a side view of a rolling head putter according to a preferred embodiment of the present invention.

Referring to FIG. 4, a side view of the rolling head putter apparatus 1 according to the current invention. As shown also in the previous figures, the putter head 2 is attached to a shaft 20, and is engaged fittingly into the shaft socket 5. The shaft and shaft socket are in themselves well known methods of securing and holding a putter head, and similar shafts and shaft attachment methods are currently envisioned for the current invention. The roller 14 is mounted for rotation on an axis which is parallel to the striking surface, and located behind the face 4 and occupies a cavity 10 within the body 6. The cavity 10 is generally within the body 6 and is encompassed and contained by a frame 8. The frame 8 also supports and contains an axle 12, the axle 12 rotatably supporting the roller 14 upon bearings.

2. Operation of the Preferred Embodiment

Figure 5:
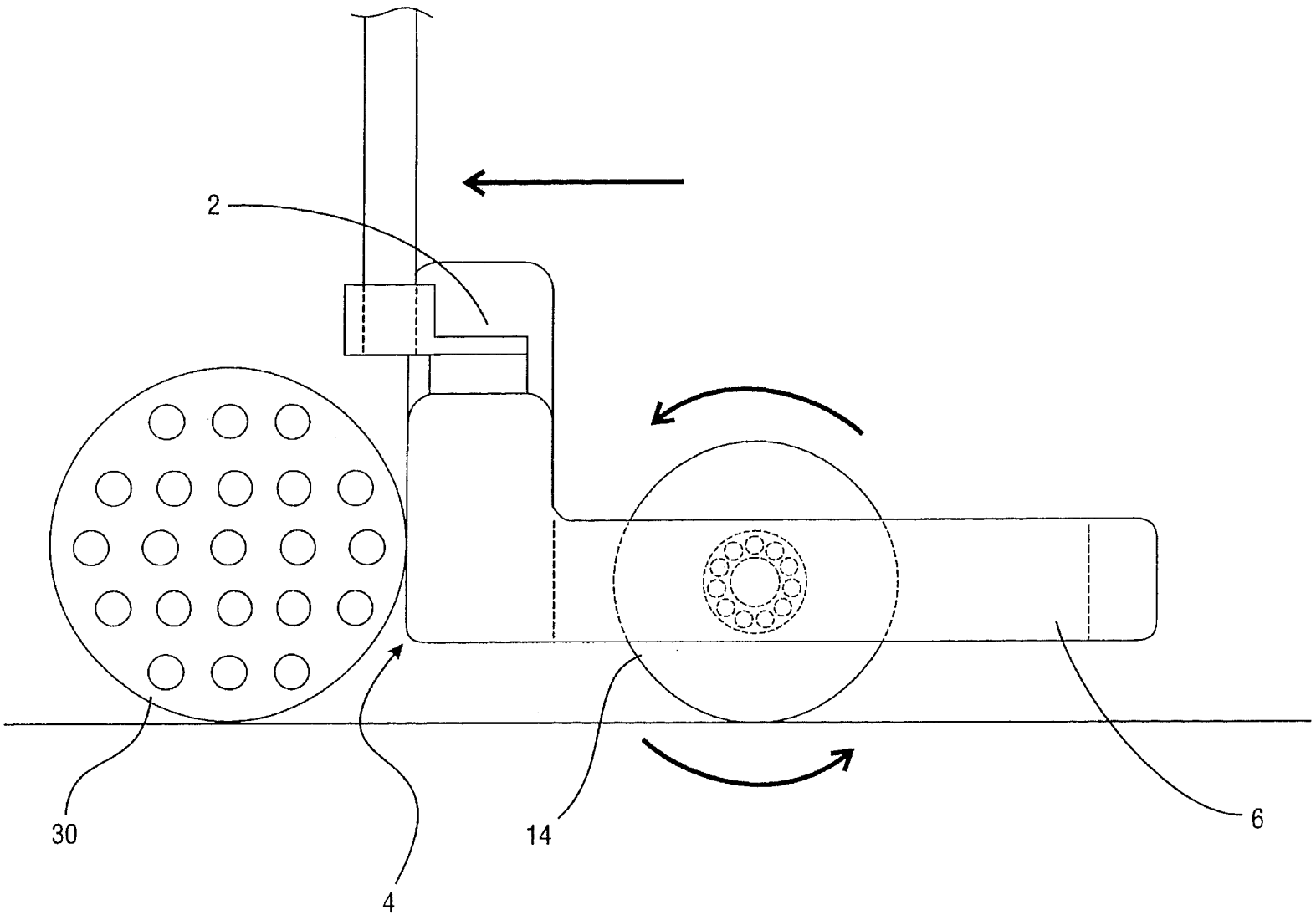
FIG. 5 is a side view of a typical application using a rolling head putter according to a preferred embodiment of the present invention.

The rolling head putter is depicted in general use in FIG. 5. As is shown in FIG. 5, in operation the present invention in its preferred embodiment is used in the game of golf to putt a golfball 30. The golfball 30 is contacted with and struck by the face 4, whereby the momentum generated by the putter head 2 is transferred to and imparted upon said golfball. As is shown, the body 6 is maintained above the ground when the roller 14 is in contact with the ground. The roller 14 is freely rotatable, and thereby easily supports the body 6 when in use. To use the present invention, a golfer sets the putter head 2 in desired alignment with the golfball 30. The roller 14 is contacted with the ground and is rolled as the golfer strokes the rolling head putter 1. By utilizing the invention during practice, the user develops the techniques required to properly putt. Through repetition of the proper club height, club direction, club swing, stroke, and followthrough, the user is developing skills and motions that become a habit that is carried over to the use of standard, regulation putters, thereby improving the use of said putters.

The foregoing description is included to illustrate the operation of the preferred embodiment and is not meant to limit the scope of the invention. Those skilled in the art will understand that changes can be made in the preferred embodiments here described, and that these embodiments can be used for other purposes. Such changes and uses are within the scope of the invention, which is limited only by the claims which follow.

What is claimed is:

1. An improved rolling head putter device for attachment to a golf club shaft, said rolling head putter device comprising:

a head, having striking surface for contacting a golfball and a perimeter, and said head having a body formed by a frame, said frame defining the boundaries of, and generally contains a cavity which extends completely through the body;

an axle, attached to said head and which generally protrudes into the space occupied by said cavity;

a roller, mounted on, supported by, and freely rotating around said axle, said roller occupying said cavity and being contained generally within the perimeter of said head; and shaft attachment means for attaching a golf club shaft to said head.

2. The improved rolling head putter device as described in claim 1, wherein said shaft attachment means comprises a generally tubular shaft socket located within said head that contains a golf club shaft when the golf club shaft is partially inserted therein.

3. The improved rolling head putter device as described in claim 1, wherein said roller includes a resilient outer peripheral surface.

4. The improved rolling head putter device as described in claim 1, wherein said roller is mounted for rotation on an axis which is parallel to the striking surface.

5. The improved rolling head putter device as described in claim 1, wherein said roller is mounted on said axle such that the outer surface of said roller extends beyond and beneath the lower surface of said head, such that said head may be advanced in the direction of the striking surface by rolling said head on said roller.

6. The improved rolling head putter device as described in claim 1, wherein said axle contains bearings to provide means for free rotatability of said roller.

7. An improved rolling head putter device for attachment to a golf club shaft, said rolling head putter device comprising:

a head, having striking surface for contacting a golfball comprising a generally flat face of a body formed by a frame, said frame defining the boundaries of, and generally contains a cavity which extends completely through the body;

an axle attached to said body;

a roller, mounted on, supported by, and freely rotating around said axle, said roller being located behind said striking surface;

said axle containing bearings to provide means for free rotatability of said roller; and shaft attachment means for attaching a golf club shaft to said head.

* * * * *